United States Patent [19]

Gartner et al.

[11] 4,228,769

[45] Oct. 21, 1980

[54] INTAKE-PIPE ARRANGEMENT FOR IN-LINE INTERNAL COMBUSTION ENGINES

[75] Inventors: Jurij Gartner, Germering; Helmut Hengl; Karl Sixt, both of Munich; Reinhard Woltmann, Puchheim, all of Fed. Rep. of Germany

[73] Assignee: Bayerische Motoren Werke Aktiengesellschaft, Fed. Rep. of Germany

[21] Appl. No.: 885,977

[22] Filed: Mar. 13, 1978

[30] Foreign Application Priority Data

Mar. 15, 1977 [DE] Fed. Rep. of Germany ..... 2711195

[51] Int. Cl.³ ..... F02B 75/18

[52] U.S. Cl. ..... 123/52 M; 123/59 R

[58] Field of Search ..... 123/52 M, 52 MC, 59 R, 123/139 AW

[56] References Cited

U.S. PATENT DOCUMENTS

| | | | |
|---|---|---|---|
| 1,985,944 | 1/1935 | Meyer | 123/52 M |
| 2,294,326 | 8/1942 | Wirth | 123/52 M |
| 3,141,449 | 7/1964 | Dika | 123/52 M |
| 3,857,573 | 12/1974 | Pugh | 123/139 AW |
| 4,013,049 | 3/1977 | Dilgard et al. | 123/52 M |
| 4,111,163 | 9/1978 | Ederer et al. | 123/52 M |

*Primary Examiner*—Charles J. Myhre
*Assistant Examiner*—Craig R. Feinberg
*Attorney, Agent, or Firm*—Craig & Antonelli

[57] ABSTRACT

An intake-pipe assembly is provided for use with internal combustion engines of the type including four to six cylinders arranged in line. The intake assembly includes an intake manifold and a plurality of intake pipes opening into respective opposite sides of the intake manifold and extending to engine inlet channel means. The intake pipes are configured so as to have substantially equal lengths and so as to extend from openings at one plane at the manifold to openings at the engine inlet channel means in a plane at right angles to the manifold connection plane. In order to optimize the utilization of space while also optimizing and maximizing the radius of curvature of the intake pipes, the pipes are arranged with intermediate curved segments which overlap one another and extend in respective planes which intersect with one another in the vicinity of a common intersection area for the intermediate curved segments and connecting end portions leading therefrom to the engine inlet channel.

22 Claims, 7 Drawing Figures

Fig.1
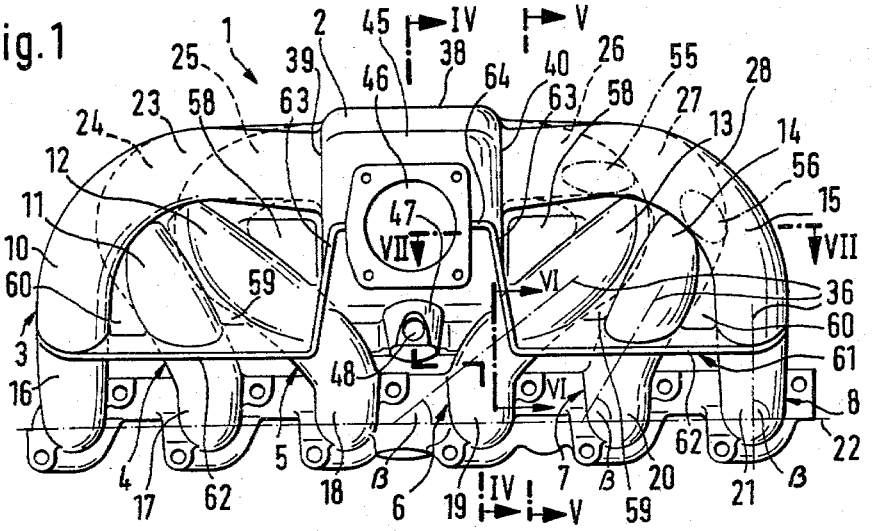
Fig.2
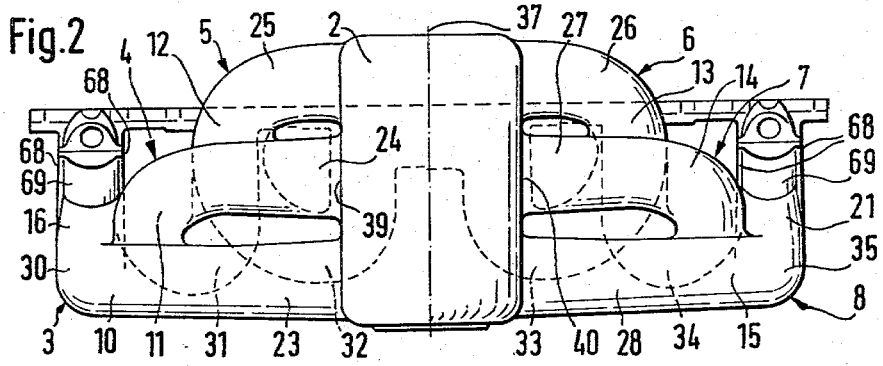
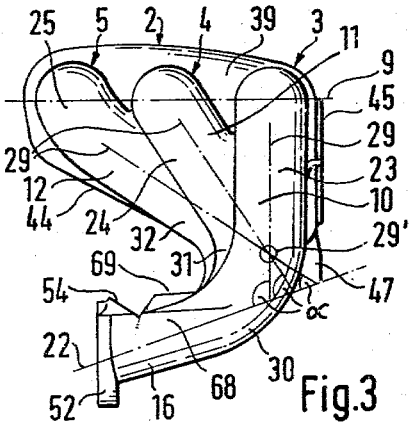
Fig.3
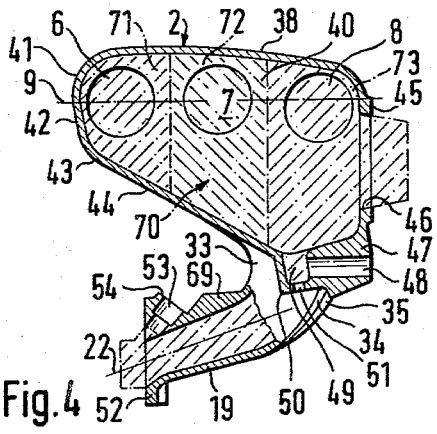
Fig.4

INTAKE-PIPE ARRANGEMENT FOR IN-LINE INTERNAL COMBUSTION ENGINES

BACKGROUND AND SUMMARY OF THE INVENTION

The invention relates to an intake-pipe assembly for internal combustion engines of the type including four to six cylinders arranged in line, or the like. More specifically, the invention relates to such an intake assembly which includes an intake manifold and a plurality of intake pipes opening into the intake manifold at one end thereof and into engine inlet channel means at the opposite ends thereof. Particularly preferred embodiments of the invention relate to arrangements with an intake manifold having intake pipes extending symmetrically therefrom at opposite sides thereof, with the intake pipes being of substantially similar lengths and extending from a connection plane at the intake manifold to a connection plane at the engine inlet channel means extending transversely to said connection plane at the intake manifold.

In a known intake-pipe assembly of this design (U.S. Pat. No. 2,862,490), for a six-cylinder engine with three carburetors, the two immediately adjacent central connecting ends are associated with first individual intake pipes, which extend from the intake manifold at the maximum distance from the connecting ends. Connecting ends which are disposed in a line with the connecting ends, outward on both sides of the above-mentioned connecting ends, are associated with the individual intake pipes, said pipes being adjacent to the first and extending from the intake manifold closer to the connecting ends, while third individual intake pipes, which are adjacent to the second and extend from the intake manifold immediately adjacent to the connecting ends, effect a transition to the outermost connecting ends. The individual intake pipes of this intake pipe assembly consist essentially of straight and diagonal segments, connected together by curves with small radii of curvature. In this design, the flow of gas or mixtures is disturbed in the individual intake tubes by turbulence, so that especially favorable torque and power cannot be achieved over the entire speed range of the engine. Furthermore, the individual intake pipes are relatively short, resulting in additional disadvantages related to torque and power.

A goal of the invention is to provide an intake pipe arrangement of the type described hereinabove, the individual intake pipes of said system having sufficiently great lengths and relatively large radii of curvature without significantly increasing the space requirements of the intake-pipe assembly.

The above-noted goal of the invention is accomplished according to particularly preferred embodiments of the invention by providing that the intermediate segments overlap one another and extend in respective intermediate segment planes, said intermediate segment planes being angularly inclined with respect to one another and intersected with one another in the vicinity of a common intersection area for said intermediate and connecting end segments.

By virtue of the design of the intake-pipe assembly according to the invention, a good vibrational behavior in the individual intake pipes and hence a good torque and power curve for the engine is achieved with very low space requirements for the intake-pipe assembly. The intake-pipe assembly according to the invention is suitable in particular for fuel-injected internal combustion engines of the Otto and Diesel types, and also for Otto engines with carburetors. By swiveling the intermediate cross sections with the intake manifold around the imaginary intersecting axes and relative to the connecting ends whose paths can be adjusted, an overall design of an intake-pipe assembly can be selected which will have the maximum suitability for specific space requirements according to particularly preferred embodiments of the invention.

Advantageous embodiments and features of the invention are characterized in the detailed description of the drawings and in the claims, said claims containing in particular features for a design of the intake-pipe assembly which is favorable for operation and easily cast and contains the casting core for its manufacture. Independent protection has been claimed for these features.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 is a front view of an intake-pipe assembly for a six-cylinder in-line internal combustion engine, constructed in accordance with a preferred embodiment of the invention;

FIG. 2 is a top view of the intake-pipe assembly according to FIG. 1;

FIG. 3 is a side view of the intake-pipe assembly according to FIG. 1;

FIG. 4 is a cross sectional view along line IV—IV in FIG. 1 with casting core features schematically illustrated;

DETAILED DESCRIPTION OF THE DRAWINGS

Figure 5:
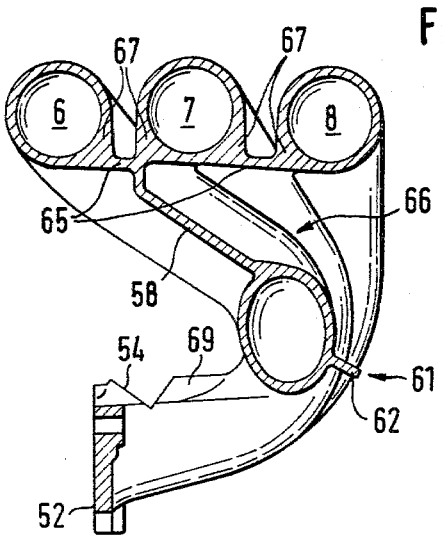
FIG. 5 is a cross sectional view along line V—V in FIG. 1.

An intake-pipe assembly 1 for a six-cylinder fuel-injected in-line internal combustion engine, designed to operate as an Otto engine, includes an intake manifold 2 and six individual intake pipes 3, 4, 5, 6, 7, and 8. Since the details of such an engine itself are well-known, the engine is not illustrated. The individual intake pipes emerge in a plane 9, parallel to one another and pairwise opposite from intake manifold 2, and are of equal length. They are provided with curved overlapping intermediate segments 10, 11, 12, 13, 14, and 15, and are provided with connecting end portions 16, 17, 18, 19, 20 and 21, which can connect them to the inlet channels of an internal combustion engine, said connecting end portions extending approximately parallel to one another in a plane 22. The connection at the manifold is along a plane which extends substantially at right angles to the connection plane at the engine. The inside cross section of the individual intake pipes 3 to 8 is circular and decreases from intake manifold 2 to connecting ends or end portions 16 to 21. Intake manifold 2 is mounted approximately at right angles to the connecting ends 16 to 21. The curved intermediate segments 10 to 15 of the individual intake pipes 3 to 8 run so that, the connecting ends 18 and 19 of pipes 5 and 6 are located immediately side by side in the middle of the row of connecting ends 16 to 21. The sequency of the connecting ends 18, 17, 16 and 19, 20, 21, starting from the middle of the row of connecting ends, corresponds to the sequence of the outlets of the individual intake pipes 3 to 8 from intake manifold 2. This means that the two central connecting ends 18 and 19 are associated with the two individual intake pipes 5 and 6, extending out from intake manifold 2 on the side (upper side of FIG. 2 illustration) of connecting ends 16 to 21, while the two outer connecting ends 16 and 21 are associated with the two individual intake pipes 3 and 8, which extend out from the side (bottom side of FIG. 2 illustration) of intake manifold 2 which is opposite connecting ends 16 to 21. The two additional individual intake pipes 4 and 7 which emerge from intake manifold 2 between the above-mentioned individual intake pipes 3 and 5 and 6 and 8 make a transition to the connecting ends 17 and 20 which are located between the respective middle and outer connecting ends 16 and 18 and 19 and 21. The curved intermediate segments 12 and 13 of individual intake pipes 5 and 6 connected with the middle connecting ends 18 and 19 are initially bent away from connecting ends 16 to 21 and then bent back toward the latter (best illustrated in FIG. 3).

Each first part 23, 24, 25, 26, 27, and 28 of the intermediate segments 10 to 15 of the individual intake pipes 3 to 8 of each pair lies approximately in a respective plane 29 which encloses an open angle $\alpha$ with plane 22 of the connecting ends 16 to 21 in the direction of the latter. Planes 29 intersect one or more parallel imaginary axes 29′ which run at right angles to the connecting ends 16 to 21. Angle $\alpha$ increases with increasing distance of the outlets of the pairs of individual intake pipes 5, 6, 4, 7, and 3, 8 from the end of the intake manifold 2 which is on the side (upper side of FIG. 2) of connecting ends 16 to 21.

Each second part 30, 31, 32, 33, 34, and 35 of intermediate segments 10 to 15 of individual intake pipes 3 to 8 lies essentially in respective plane 36, said planes 36 enclosing with plane 22 of connecting ends 16 to 21, respective open angles $\beta$ which are directed away from the intake manifold. Angle $\beta$ increases with increasing distance of connecting ends 18, 19, 17, 20 and 16 and 21 from the middle of the row of connecting ends, with plane 36 in which the two parts 30, 35 of the curved intermediate segments 16, 21 of the two individual intake pipes 3 and 8 lie with their outer connecting ends 16 and 21 is approximately parallel to the central lengthwise plane 37 of the intake manifold 2.

Intake manifold 2 has a slightly curved upper side 38, said upper side 38 being located in a plane parallel to the ends of individual intake pipes 3 to 8 extending out from intake manifold 2, and two mutually parallel lateral walls 39 and 40 at right angles thereto. At the end of the intake manifold 2 which faces the connecting ends 16 to 21, upper side 38 is bent downward in a curve 41 and makes a transition to a low end wall 42, said wall 42 making a transition with a further curve 43 to a diagonal bottom 44 (FIG. 4). Diagonal bottom 44 faces connecting ends 16 to 21 and is located approximately parallel to plane 29, in which the first parts 25 and 26 of intermediate segments 12 and 13 of individual intake pipes 5 and 6 connected with central connecting ends 18 and 19 lie. At its end facing away from connecting ends 16 to 21, intake manifold 2 is provided with a wall 45, said wall being disposed approximately parallel to the first parts 23 and 28 of intermediate segments 10 and 15 of individual intake pipes 3 and 8 which make the transition to the outer connecting ends 16 and 21. An opening 46 is provided in wall 45, to which opening an air supply line, not shown, is connectable. Below opening 46, a hole 48 for an auxiliary air connection, not shown, is provided in a stub 47 on intake manifold 2, said auxiliary air connection terminating in a depression 49 at the lowest point on intake manifold 2. A hole 51 for a starter nozzle, not shown, is disposed in the bottom 50 of depression 49.

Connecting ends 16 to 21 are provided with flanges 52, said flanges being connected together in the vicinity of their halves, in the area facing intake manifold 2. In the wall of each connecting end 16 to 21, facing diagonal bottom 44, a diagonal through-hole 53 in the direction of flange 52 and a support surface 54 are provided, into which an injection nozzle, not shown, is insertable.

This design of the intake manifold 2 and the individual intake pipes 3 to 8 connected thereto together with their connecting ends 16 to 21 can be disposed in a narrow space with individual intake pipes of equal length with relatively large radii of curvature and considerable lengths.

Intake-pipe assembly 1 can be manufactured as a one-piece casting. For this reason it is designed so that it is relatively easy and simple to shape and free of undercuttings.

Figure 6:
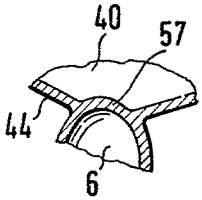
FIG. 6 is a cross sectional view along line VI—VI in FIG. 1.
Figure 7:
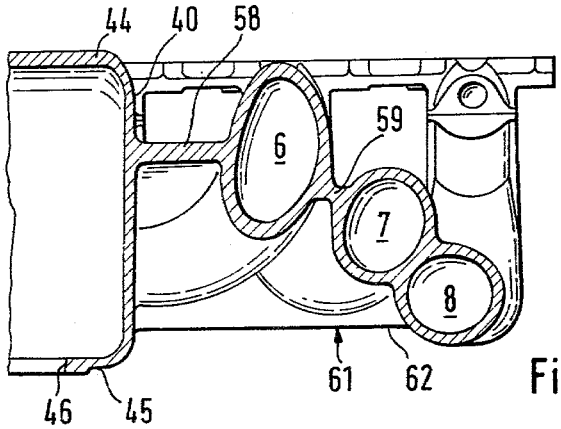
FIG. 7 is a cross sectional view along line VII—VII in FIG. 1.

Individual intake pipes 3 to 8, in the areas which overlap one another, have common wall segments 55, 56 and the two individual intake pipes 5 and 6 which terminate in the middle connecting ends 18 and 19 also have common wall segments 57 (FIG. 6) with intake manifold 2. This produces not only greater rigidity but also greater freedom in shaping.

In addition, the intake-pipe assembly is designed so that for molding it, a mold will suffice which includes only two mold parts and two mold slides. The individual intake pipes 3 to 8 are connected together partially by walls 58, 59, and 60 by mold joints. Each of these walls 58 extends between the lateral wall 39 and 40 of the intake manifold 2 and the first part 25 or 26 of the curved intermediate segment 12 or 13 of individual intake pipe 5 or 6, which extends out from connecting ends 16 to 21 immediately adjacent to intake manifold 2. The walls 58 lie approximately parallel to the diagonal bottom 44 of intake manifold 2. Additional walls 59, 60, which are continuations of walls 58, extend between individual intake pipes 3 to 5 and 6 to 8 according to the maximum angle $\alpha$ relative to connecting ends 16 to 21 up to a rib 61, whose main part 62 connects the individual intake pipes 3 to 8 in the vicinity of the transition from their curved intermediate segments 10 to 15 to connecting ends 16 to 21. Rib 61 is located in a mold surface and extends in a plane which is parallel to the diagonal bottom 44 of the intake manifold 2. In the vicinity of intake manifold 2, rib 61 is displaced parallel toward opening 46 of intake manifold 2, whereby transitional segments 63 connect the displaced parts 64 of rib 61 with the two main parts 62. Additional walls 65, abutting lateral walls 39 and 40 of intake manifold 2, rest against the side of the individual intake pipes 3 to 8 which is turned toward the above-mentioned walls 58 to 60 and rib 61, in the vicinity of the point at which these individual pipes emerge from intake manifold 2, and these walls 65 then extend up to the transition from the first parts 23 to 28 of curved intermediate segments 10 to 15 to the second parts 30 to 35 of the curved intermediate segments 10 to 15. Walls 65 and the above-mentioned walls 58 merge with one another and form on either side of the intake manifold 2, a niche 66, which can be molded and is free of undercutting. Downstream of rib 61, individual intake pipes 3 to 8 are not connected together by intermediate wall parts. Only flanges 52 of their connecting ends 16 to 21 are connected togther. Since the individual intake pipes 3 to 8, in the area in which they emerge from intake manifold 2, are located partially eccentrically relative to the mold joint, they are provided with extensions 67, which extend tangentially to the otherwise circular outside contour approximately in the forming direction up to wall 65 which is disposed in a mold joint. The mold joint likewise runs eccentrically in the vicinity of connecting ends 16 to 21, so that connecting ends 16 to 21 are also provided with extensions 68, extending tangentially with respect to the otherwise generally circular outer contour, approximately in the forming direction up to the mold joint. On the sides of connecting ends 16 to 21 which face the diagonal bottom 44 of intake manifold 2, a lengthwise bead 69 is provided, said bead extending approximately parallel to the forming direction and containing a through hole to accept an injection nozzle. Abutting surfaces 54 in the walls or lengthwise beads 69 at the abutting ends can be ground in a single work step.

Tangential extensions 67, 68 allow simple forming of the suction-pipe assembly without loose parts. Walls 58 to 60 and 65 as well as rib 61, disposed between intake manifold 2 and individual intake pipes 5 and 6 or between the individual intake pipes eliminate or facilitate cleaning work and confer increased rigidity on intake pipe assembly 1. The lengthwise beads 69, extending approximately up to the point of transition of the connecting ends 16 to 21 to the curved intermediate segments 10 to 15, likewise serve to avoid undercutting.

The casting core 70, shown in FIG. 4 by dash-dot lines and dash-dot shaded areas, for casting the intake-pipe assembly 1 consists of three core segments 71, 72, 73, interlocking with each other in the vicinity of intake manifold 2 and connected together two-dimensionally. Each of these core segments 71, 72, 73, consists of one core part for the intake manifold and two core parts for each two individual intake pipes 5 and 6, 4 and 7, or 3 and 8, emerging opposite one another from intake manifold 2. This division allows core 70 to be manufactured relatively simply and economically. Moreover, a casting skin or flash may form at certain points in the intake manifold, and the flow will not be disadvantageously influenced by the casting skin or flash.

The intake-tube assembly disclosed and described above can be modified, according to other contemplated preferred embodiments of the invention, especially for five- and four-cylinder in-line internal combustion engines, in simple fashion by eliminating one or two of the outer individual intake pipes. Then both the pattern of the individual intake pipes and the position of the intake housing relative to the connecting ends can be varied considerably by parallel displacement and/or swiveling around the above-mentioned intersecting axes of the planes of the intermediate segments, in accordance with the individual spatial requirements within the scope of the invention. In the case of engines with carburetors, it is merely necessary to adapt the intake manifold to accept the carburetor connections. The ends of the individual intake pipes, extending out from the intake manifold can, within the scope of other preferred embodiments of the invention, be in a triangular arrangement instead of being in a plane 9; in this triangular arrangement, the ends of the middle individual intake pipes 4 and 7 have a greater distance than that shown from the imaginary axes 29'. If necessary, this permits an even lower structural height for the intake manifold and hence for the entire intake-pipe assembly.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Intake-pipe assembly, for internal combustion engines of the type including four to six cylinders arranged in a line or the like, comprising:

an intake manifold;

and a plurality of intake pipes of substantially similar total lengths extending from said intake manifold in approximately one plane, pairwise and opposite one another, each of said intake pipes including a manifold end segment, a connecting end segment having an extreme end portion attachable to inlet channel means of an engine and a curved intermediate segment interconnecting the respective manifold end segments and connecting end segments, the connecting end segments being arranged approximately parallel to one another and approximately at right angles to the manifold segments emerging from the intake manifold, wherein said intermediate segments overlap one another and extend pairwise in respective intermediate segment planes intersecting said one plane at different angles, said intermediate segment planes being angularly inclined with respect to one another and intersecting with one another in the vicinity of the connecting end segments in a common intersection area which runs at right angles to the connecting end segments.

2. Assembly according to claim 1, wherein the extreme end portions of the connecting end segments are disposed in a common engine connection plane which extends transversely to a manifold connection plane where said manifold end segments open into said intake manifold.

3. Assembly according to claim 2, wherein said engine connection plane and manifold connection plane extend at substantially right angles to one another.

4. Assembly according to claim 3, wherein the manifold end segments of the respective intake pipes are disposed at different distances relative to said common intersection area, the intake pipes with manifold end segments spaced furtherest from said common intersection area being connected closest to the center of the engine inlet channel means and the intake pipes with manifold end segments closest to said common intersection area being connected to the engine inlet channel means outwardly of said other intake pipes.

5. Assembly according to claim 4, wherein at least the curved intermediate segments of the intake pipe having manifold end segments spaced furtherest from said common intersection area are curved in an approximately S-shape first toward the connecting end segments, then toward one another, and finally toward their respective connecting end segments.

6. Assembly according to claim 5, in the form of an integral one-piece cast construction, wherein a first part of the intermediate segments of the individual intake pipes of each pair lies approximately in a plane which forms with a plane of connecting end segments, an angle $\alpha$ which is open in the direction of the connecting ends, said angle being greater with increasing distance of the outlets of pairs of individual intake pipes from the end of the intake manifold which is located on the side of the connecting ends, and wherein a second part of the intermediate segments of the individual intake pipes lies essentially in a plane, which together with the plane of the connecting end segments, encloses an open angle ($\beta$) directed away from intake manifold, said angle ($\beta$) being smallest for the middle connecting end segments and largest for the outer connecting end segments.

7. Assembly according to claim 6, wherein the intake manifold is provided with a diagonal bottom facing the connecting end segments, said bottom being located approximately parallel to the plane in which the first part of the intermediate segment of the individual intake pipes connected with middle portions of the connecting end segments lies.

8. Assembly according to claim 6, wherein the individual intake pipes are connected with one another at least partially in the area of mold joints by walls.

9. Assembly according to claim 6, wherein the individual intake pipes are provided in the vicinity of their connecting end segments, on the outer sides facing the intake manifold, with one lengthwise bead each, said bead extending approximately from one end, provided with a flange, to a gradient in the curved intermediate segment, and wherein a through-bore, located diagonally relative to the direction of the connecting end segment, is broached to accept an injection nozzle.

10. Assembly according to claim 6, wherein the individual intake pipes have approximately internal circular cross sections and are provided with extensions externally in areas in which they are located eccentrically relative to mold joints, said extensions extending tangentially to the otherwise circular outer contour approximately in the forming direction up to the mold joint or a wall disposed there.

11. Assembly according to claim 10, wherein the curved intermediate segments of those individual intake pipes which emerge from intake manifold on the side of the connecting end segments, contact intake manifold with their central areas and have a common wall segment with the latter, wherein a wall extends approximately parallel to the diagonal bottom of intake manifold, said wall lying in a mold joint and being located between the intake manifold and the first parts of these intermediate segments, and wherein the sides of the individual intake pipes facing these walls are located in a mold joint in the area of their emergence from the intake manifold and each form an approximately wedge-shaped niche with these walls.

12. Assembly according to claim 11, wherein a rib for connecting individual intake pipes diagonally with one another is located in a mold joint approximately in the same plane with the diagonal bottom of the intake manifold and commonly with the walls approximately parallel to said manifold, and wherein the rib extends in the area of an endwise opening in the intake manifold, out of its main plane to both sides up to approximately the center of an opening.

13. Assembly according to claim 12, wherein individual intake pipes are connected with one another by walls located in mold joints downstream from the rib in the direction of the intake manifold, and wherein said individual intake pipes are separated from one another in the direction of the connecting end segments with the exception of flanges of the latter which are connected with one another.

14. Assembly according to claim 5, wherein the plane in which the curved intermediate segments of the two individual intake pipes emerging from intake manifold closest to the common intersection area lie, is disposed approximately at right angle to the plane in which the ends of individual intake pipes emerging from the intake manifold lie.

15. Assembly according to claim 14, in the form of an integral one-piece construction, wherein a first part of the intermediate segments of the individual intake pipes of each pair lies approximately in a plane which forms with a plane of connecting end segments, an angle $\alpha$ which is open in the direction of the connecting ends, said angle being greater with increasing distance of the outlets of pairs of individual intake pipes from the ends of the intake manifold which is located on the side of the connecting ends, and wherein a second part of the intermediate segments of the individual intake pipes lies essentially in a plane, which together with the plane of the connecting end segments, encloses an open angle ($\beta$) directed away from intake manifold, said angle ($\beta$) being smallest for the middle connecting end segments and largest for the outer connecting end segments.

16. Assembly according to claim 15, wherein the intake manifold is provided with a diagonal bottom facing the connecting segments, said bottom being located approximately parallel to the plane in which the first part of the intermediate segments of the individual intake pipes connected with middle portions of the connecting end segments lies.

17. Assembly according to claim 16, wherein the individual intake pipes are connected with one another at least partially in the area of mold joints by walls.

18. Assembly according to claim 17, wherein the individual intake pipes have approximately internal circular cross sections and are provided with extensions externally in areas in which they are located eccentrically relative to mold joints, said extensions extending tangentially to the otherwise circular outer contour approximately in the forming direction up to the mold joint or a wall disposed there.

19. Assembly according to claim 18, wherein the curved intermediate segments of those individual intake pipes which emerge from intake manifold on the side of the connecting end segments, contact intake manifold with their central areas and have a common wall segment with the latter, wherein a wall extends approximately parallel to the diagonal bottom of intake manifold, said wall lying in a mold joint and being located between the intake manifold and the first parts of these intermediate segments, and wherein the sides of the individual intake pipes facing these walls are located in a mold joint in the area of their emergence from the intake manifold and each form an approximately wedge-shaped niche with these walls.

20. Assembly according to claim 19, wherein a rib for connecting individual intake pipes diagonally with one another is located in a mold joint approximately in the same plane with the diagonal bottom of the intake manifold and commonly with the walls approximately parallel to said manifold, and wherein the rib extends in the area of an endwise opening in the intake manifold, out of its main plane to both sides up to approximately the center of an opening.

21. Assembly according to claim 20, wherein individual intake pipes are connected with one another by walls located in mold joints downstream from the rib in the direction of the intake manifold, and wherein said individual intake pipes are separated from one another in the direction of the connecting end segments with the exception of flanges of the latter which are connected with one another.

22. Assembly according to claim 21, wherein the individual intake pipes are provided in the vicinity of their connecting end segments, on the outer sides facing the intake manifold, with one lengthwise bead each, said bead extending approximately from one end, provided with a flange, to a gradient in the curved intermediate segment, and wherein a through-bore, located diagonally relative to the direction of the connecting end segment, is broached to accept an injection nozzle.

* * * * *